US007079797B2

(12) United States Patent
Shinohara et al.

(10) Patent No.: US 7,079,797 B2
(45) Date of Patent: Jul. 18, 2006

(54) OFFSET PREVENTING COLOR IMAGE FORMING APPARATUS

(75) Inventors: Tadashi Shinohara, Yokohama (JP); Toshiyuki Takahashi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 10/893,261

(22) Filed: Jul. 19, 2004

(65) Prior Publication Data

US 2005/0042001 A1 Feb. 24, 2005

(30) Foreign Application Priority Data

Jul. 18, 2003 (JP) ..... 2003-199534

(51) Int. Cl.
*G03G 15/01* (2006.01)

(52) U.S. Cl. ..... 399/301; 399/167; 399/302; 399/395; 399/396

(58) Field of Classification Search ..... 347/116; 399/9, 36, 167, 297, 299, 301, 394, 395, 399/396

See application file for complete search history.

(56) References Cited

U.S. PATENT DOCUMENTS 5,621,221 A 4/1997 Shinohara et al.
5,737,665 A 4/1998 Sugiyama et al.
5,765,083 A 6/1998 Shinohara
5,802,422 A * 9/1998 Hokari ..... 399/36
5,875,380 A 2/1999 Iwata et al.
5,899,597 A 5/1999 Shinohara et al.
5,962,783 A 10/1999 Iwata et al.
5,963,240 A 10/1999 Shinohara et al.
6,118,557 A 9/2000 Sugiyama et al.
6,128,459 A 10/2000 Iwata et al.
6,179,419 B1 * 1/2001 Rasmussen et al. ..... 347/104
6,282,396 B1 8/2001 Iwata et al.
6,295,435 B1 9/2001 Shinohara et al.
6,380,960 B1 4/2002 Shinohara
6,381,435 B1 4/2002 Shinohara et al.
6,573,918 B1 6/2003 Shinohara et al.

(Continued)

FOREIGN PATENT DOCUMENTS

JP 9-267946 10/1997

(Continued)

*Primary Examiner*—Hoang Ngo
(74) *Attorney, Agent, or Firm*—Oblon, Spivak, McClelland, Maier & Neustadt, P.C.

(57) ABSTRACT

An image forming apparatus forms a toner image on a moving member by transferring and superposing component color toner images formed on an image bearer. An image forming apparatus includes a driving device that rotates and transports a moving member, a moving value detecting device that detects one of a moving length and a moving speed of the moving member, and a deviation calculating device that calculates a deviation value of one of the moving length and the moving speed by subtracting the detected one of the moving length and the moving speed from a reference value. An adjustment value calculating device calculates an adjustment value in accordance with the calculated deviation value. A driving speed control device controls a driving speed of the driving device in accordance with the calculated adjustment value. A deviation removing device removes prescribed deviation in one of the moving length and the moving speed detected by the moving value detecting device based on the calculated deviation value and the calculated adjustment value. The deviation removing device removes deviation not giving influence to traveling of the moving member at least at the transfer station.

15 Claims, 13 Drawing Sheets

U.S. PATENT DOCUMENTS

| | | | |
|---|---|---|---|
| 6,587,137 | B1 | 7/2003 | Shinohara et al. |
| 6,693,654 | B1 | 2/2004 | Shinohara |
| 6,704,035 | B1 | 3/2004 | Kobayashi et al. |
| 6,711,364 | B1 | 3/2004 | Shinohara |
| 6,714,224 | B1 | 3/2004 | Yamanaka et al. |
| 2002/0136570 | A1 | 9/2002 | Yamanaka et al. |
| 2003/0137577 | A1 | 7/2003 | Shinohara |
| 2004/0041896 | A1 | 3/2004 | Shinohara |

FOREIGN PATENT DOCUMENTS

| | | |
|---|---|---|
| JP | 3153331 | 1/2001 |

* cited by examiner

OFFSET PREVENTING COLOR IMAGE FORMING APPARATUS

This patent document claims priority under 35 USC § 119 to Japanese Patent Application No. 2003-199534 filed on Jul. 18, 2003, the entire contents of which are herein incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Invention

The present invention relates to image forming apparatuses, such as facsimiles, printers, copiers, etc., and in particular to image forming apparatuses capable of transferring a visual image formed on an image bearer to a moving member such as a transfer belt at a position at which the image bearer contacts the moving member.

2. Background of the Invention

A background color image forming apparatus forms a color image by superposing component color (i.e., Y, M, C, and K) images formed on respective photoconductive (PC) drums using a laser light. This method sometimes raises a considerable problem. That is, respective distances and parallelism between shafts of the PC drums are, at times, unequal. An error occurs in setting a deflection mirror, which deflects a laser light irradiated from an exposure instrument. Occasionally the time varies when a latent image is written to each of the respective PC drums. As a result, superposed toner images do not fully coincide with a prescribed position, and displacement takes place between the respective color component toner images. Various countermeasures have been developed to help solve this problem.

For example, as shown in FIG. 14, a background image forming apparatus attempts to stabilize the traveling performance of a conveyance belt by detecting and correcting dynamic deviation in the belt moving speed as an AC component. Such an image forming apparatus includes a rotary encoder 20, an FV converter 22, a filter 23, a comparator 25, a motor driver 26, and a conveyance belt driving motor 27. The FV converter 22 converts a square-wave pulse train detected by the rotary encoder 20 into a voltage signal. A shaft vibration, for example, caused by an error in assembling the rotary encoder 20 to a driven roller 8A is superposed as a noise on such a voltage signal. The filter 23 then filters out the shaft vibration occurring at a specific frequency, and the comparator 25 calculates a difference between the voltage signal and a reference speed instruction signal 24.

The comparator 25 then outputs a control signal to a motor driver 26 in accordance with the difference. The motor driver 26 controls the rotational speed of the conveyance belt driving motor 27 in accordance-with the control signal upon its input.

Further, as discussed in Japanese Patent Application Laid Open No. 9-267946, to suppress the above-mentioned displacement, an angular speed of a driven roller rotating in synchronism with an intermediate transfer belt is detected and a filter device filters out a rotational deviation of the driven roller occurring at a predetermined frequency from the detected angular speed deviation. Then, the belt traveling speed can be controlled in accordance with the filtered angular speed deviation.

Further, according to a color image forming apparatus described in Japanese Patent Registration No. 3153331, the displacement is suppressed by detecting unevenness and controlling a rotational speed of a PC drum driving motor based upon an alternate current component included in a current wave of the PC driving motor.

However, since the filter device employed in the above-noted art is hardware based and formed from an LC circuit and similar devices, it causes unevenness of filtering performance. Thus, the background art devices have poor frequency performance due to a fluctuation factor, such as unevenness of parts and operational temperature, elapsing of time, etc. As a result, the belt cannot predictably travel at a prescribed frequency. To resolve such a problem, parts of the filter require a higher level of precision. However, with the introduction of more precise components the cost necessarily increases.

SUMMARY

Accordingly, an object of the present invention is to address and resolve the above-mentioned problems, as well as provide a new and novel color image forming apparatus by forming a toner image on a moving member by transferring and superposing component color toner images formed on an image bearer. Such a new and novel color image forming apparatus includes a driving device that rotates and transports a moving member, a moving value detecting device that detects one of a moving length and a moving speed of the moving member, and a deviation calculating device that calculates deviation of one of the moving length and the moving speed by subtracting the detected one of the moving length and the moving speed from a reference value.

In a preferred embodiment, an adjustment value calculating device is provided to calculate an adjustment value in accordance with the deviation. A driving speed control device is provided to control a driving speed of the driving device in accordance with the adjustment value. A deviation removing device is provided to remove prescribed deviation in one of moving length and speed detected by the moving value detecting device, based on a deviation value calculated by the deviation calculating device, and an adjustment value calculated by the adjustment value calculating device. In the preferred embodiment, the deviation removing device removes deviation without giving influence to traveling of the moving member at least at the transfer station.

In another embodiment, a driven roller contact-driven by the moving member is further provided and the moving value detecting device is connected to a rotary shaft of the first driven roller. In the preferred embodiment, the deviation removing device removes rotational deviation occurring in the first driven roller.

In yet another embodiment, a driven roller disconnected to the moving value detecting device, which is contact-driven by the moving member, is further provided and the deviation removing device removes rotational deviation occurring in the driven roller.

In yet another embodiment, the moving member includes one of a recording medium that receives the component color toner image and a conveyance belt configured to convey the recording medium.

In yet another embodiment, the moving member includes an intermediate transfer belt onto which the component color toner images are transferred.

DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
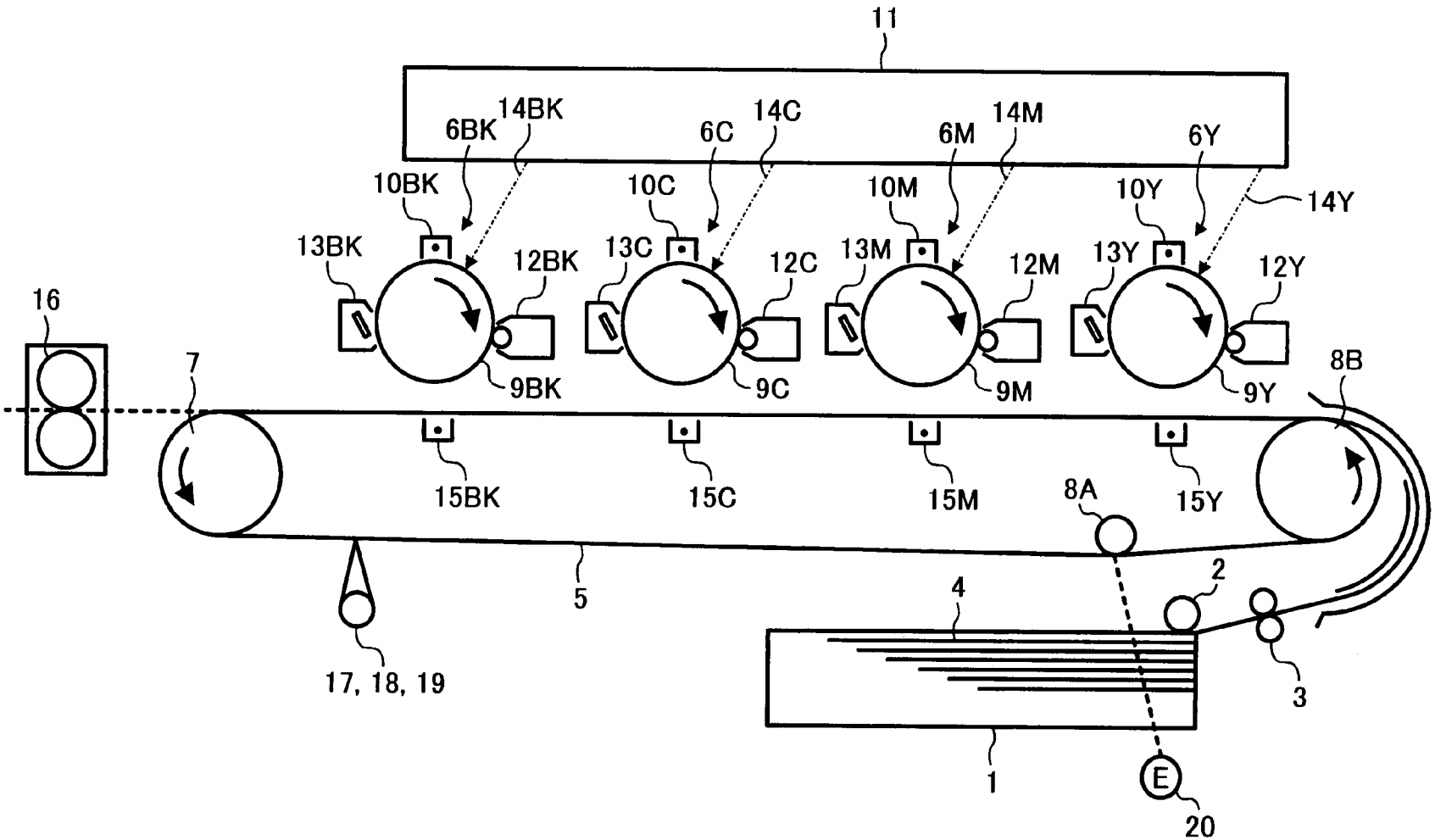
FIG. 1 illustrates a configuration of an exemplary image forming apparatus according to a first preferred embodiment of the present invention.

Referring now to the drawing, wherein like reference numerals designate identical or corresponding parts throughout several views, an embodiment of the present is described. In FIG. 1, an image forming apparatus of the first embodiment is a tandem type color image forming apparatus with a plurality of image forming sections arranged along a conveyance belt.

As shown, the image forming apparatus includes a sheet tray 1, a sheet feeding roller 2, a separation roller 3, a conveyance belt 5, a plurality of image forming units 6Y, 6M, 6C, and 6BK, a driving roller 7, a pair of driven rollers 8A and 8B, a plurality of PC drums 9Y, 9M, 9C, and 9BK, a plurality of chargers 10Y, 10M, 10C, and 10BL, an exposure device 11, a plurality of developing devices 12Y, 12N, 12C, and 12BK, a plurality of charge removers 13Y, 13M, 13C, and 13BK, a plurality of transfer devices 15Y, 15M, 15C, and 15BK, a fixing device 16, a pair of sensors 17, 18, and 19, and a rotary encoder 20.

The conveyance belt 5 conveys a sheet 4 separated and fed by the sheet feeding and separation rollers from the sheet tray 1.

The respective image forming sections 6Y, 6M, 6C, and 6BK form Yellow (Y), Magenta (M), Cyan (C), and Black (BK) images. Each of the respective image forming sections has substantially the same internal configuration. Thus, the image forming section 6Y is typically hereinafter described. Specifically, the description of the image forming sections 6M, 6C, and 6BK are omitted due to their similarity to image forming section 6Y, signs M, C, and BK to various elements forming the respective image forming sections 6M, 6C, and 6BK instead of the sign Y as illustrated in several corresponding drawings.

The conveyance belt 5 is continuous and is wound around a driving roller 7 and the pair of driven rollers 8A and 8B. The conveyance belt 5 is arranged being opposed to the respective image forming sections 6Y, 6M, 6C, and 6BK When forming an image, the sheets 4 accommodated in the sheet tray 1 are launched one by one from the top, and are adhered to the conveyance belt 5 because of its electrostatic influence. The conveyance belt 5 is driven and conveys the sheet to the fist image forming section 6Y. The sheet then receives transfer of a yellow toner image.

The image forming section 6Y is formed from a PC drum 9Y and surroundings thereof, such as a charger 10Y, an exposure device 11, a developing device 12Y, a PC cleaner (not shown), a charge remover, etc., arranged around the PC drum 9Y. The exposure device 11 is configured to irradiate various exposure lights (e.g. laser lights) 14Y, 14M, 14C, and 14BK corresponding to color images to be formed in the respective image forming sections 6Y, 6M, 6C, and 6BK.

A circumferential surface of the PC drum 6Y is uniformly charged by the charger 10Y, and then receives exposure of the laser light 14Y for a yellow image from the exposure 11, thereby forming a latent image. The latent image is visualized with yellow toner by the developing device 12Y on the PC drum 9Y.

The yellow toner image is transferred onto the sheet 4 by the transfer device 15Y at a transfer position at which the sheet 4 on the conveyance belt 5 contacts the PC drum 9Y. After completing the transfer and carrying unnecessary toner on its outer surface, the PC drum 9Y undergoes cleaning by way of a PC cleaner. The PC drum 9Y then undergoes charge removal performed by the charge remover 13Y and enters a standby state until the next image is formed.

The sheet 4 carrying the yellow toner image is then conveyed by the conveyance belt 5 to the next image forming section 6M. A magenta toner image is formed on the PC drum 9M using a process similar to that described above, and is superposed on the sheet 4 in the image forming section 6M. The sheet 4 is further conveyed to the subsequent image forming sections 6C and 6BK. Both the cyan and black images are then similarly formed on the PC drums 9C and 9BK, respectively, and are superposed on the sheet 4, thus generating a full-color image. The sheet 4 carrying-the full-color superposition image is separated from the conveyance belt 5 and is fixed by the fixing device 16 onto the sheet. The sheet is then ejected.

However, the above-mentioned color image forming apparatus raises the earlier mentioned problems. That is, respective distances and parallelism between shafts of the PC drums 9Y, 9M, 9C, and 9BK sometimes differ. An error occurs in setting a deflecting mirror (not shown), which deflects a laser light in the exposure instrument 11. Occasionally, a time varies when a latent image is written to each of the respective PC drums of 9Y, 9M, 9C, and 9BK. As a result, the conveyance speed or the like of the conveyance belt 5 is uneven and respective toner images do not coincide on a prescribed position, thus resulting in displacement between the respective toner colors. This displacement of the toner images requires correction. To detect and correct a static displacement (e.g. a DC component), a plurality of sensors 17, 18, and 19 are arranged opposed to the conveyance belt 5 and downstream of the image forming section 6BK, as illustrated in FIG. 1. These sensors 17, 18, and 19 are supported on the same substrate in a main scanning direction substantially perpendicular.

Further, to detect and correct a dynamic displacement (an AC component) caused by unevenness of conveyance speed of the conveyance belt 5, a rotary encoder 20 is attached to a rotary shaft of a driven roller 8A. The rotary encoder 20 detects a moving length or a moving speed when the driven roller 8A is rotated by one pulse. The rotary encoder 20 detects and outputs the moving length or moving speed to a CPU, described later in greater detail.

Factors possibly causing displacement in component colors include askew, registration displacements in both main and sub-scanning directions, as well as magnification error in the main-scanning direction, as examples.

Figure 2:
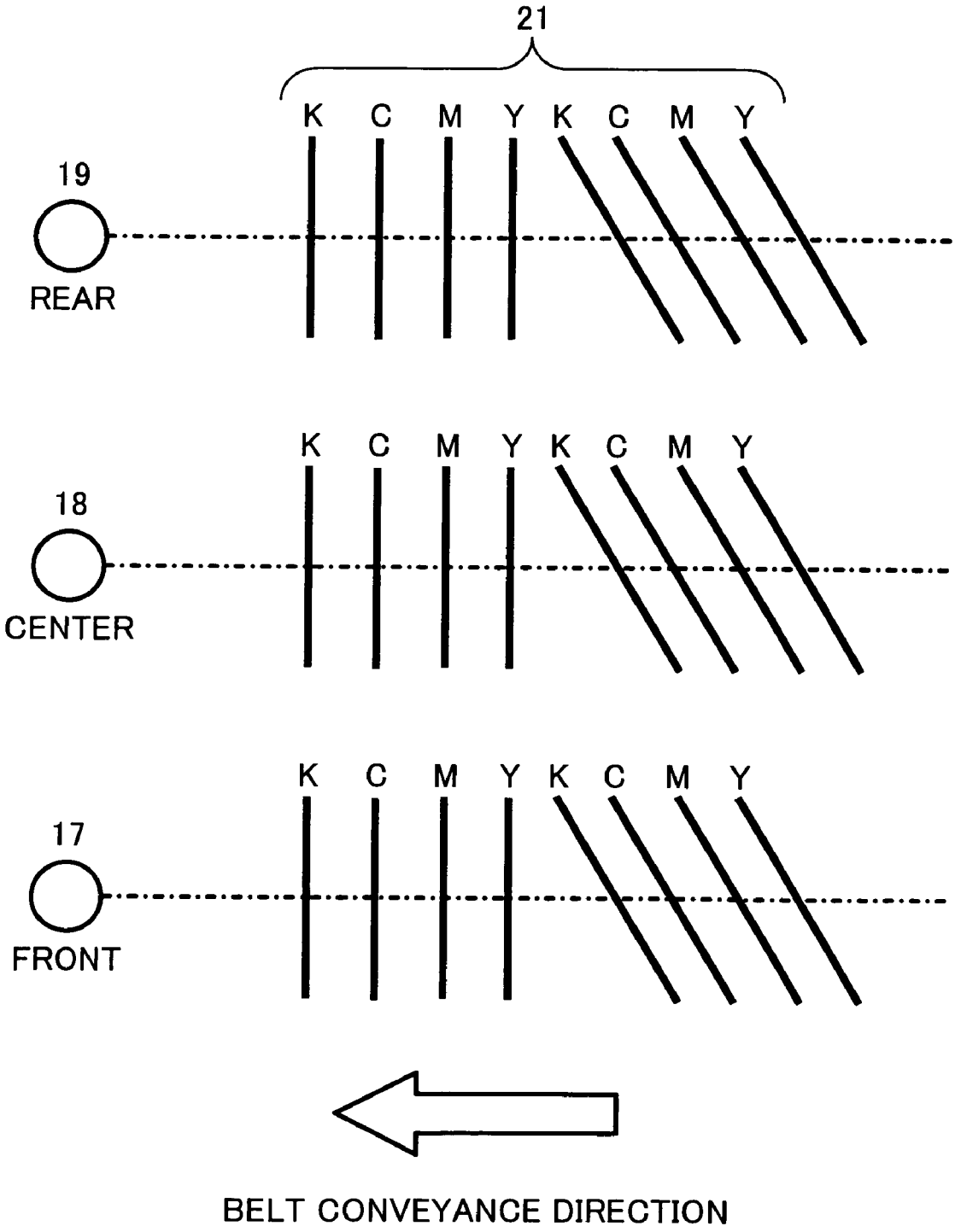
FIG. 2 illustrates an exemplary toner mark for positioning use formed on a conveyance belt employed in the first preferred embodiment.

Referring now to FIG. 2, an exemplary toner mark train 21 formed on the conveyance belt 2 is now described. As shown in FIG. 2, by forming and detecting respective lateral and oblique lines of K, C, M, and Y colors with the plurality of sensors 17, 18, and 19, skew in relation to a reference color (e.g. a BK), registration displacements both in main and sub scanning directions, and a magnification error in the main scanning direction can be measured. Based upon a detection result, various displacements and correction amounts are calculated and respective corrections are then executed by the CPU as described below.

The correction of the skew is executed by changing an inclination of a mirror (not shown), which reflects the laser light for each color arranged in the exposure device 11. A stepping motor can be employed as a driving source for inclining the mirror.

Figure 3:
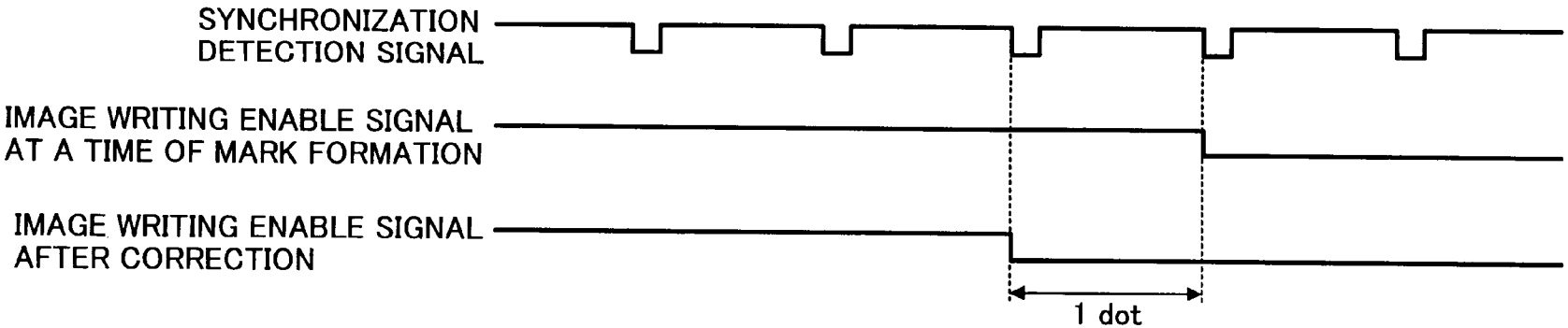
FIG. 3 illustrates the generation of a synchronization detection signal giving a write start time in a sub-scanning direction, an image write enable signal for mark formation, and a corrected image write enable signal.

With reference to FIG. 3, a sequence of a synchronous detection signal for correcting a write start time in the sub-scanning direction, an image write enable signal for forming marks, and a corrected image write enable signal generated in the first preferred embodiment will now be described. In this preferred embodiment, it is premised that correctable resolution is one dot, for example. An image regional signal (e.g. an image write enable signal) adjusts a write start time for the exposure device 11 to write on each of the PC drums 9Y, 9M, 9C, and 9BK in the sub-scanning direction in synchronism with a synchronizing detection signal. When a write start position is to be precedent by one dot in light of a result of the above-mentioned mark detection and calculation, a write enable signal is preferably activated earlier by a time corresponding to one synchronizing detection signal.

Figure 4:
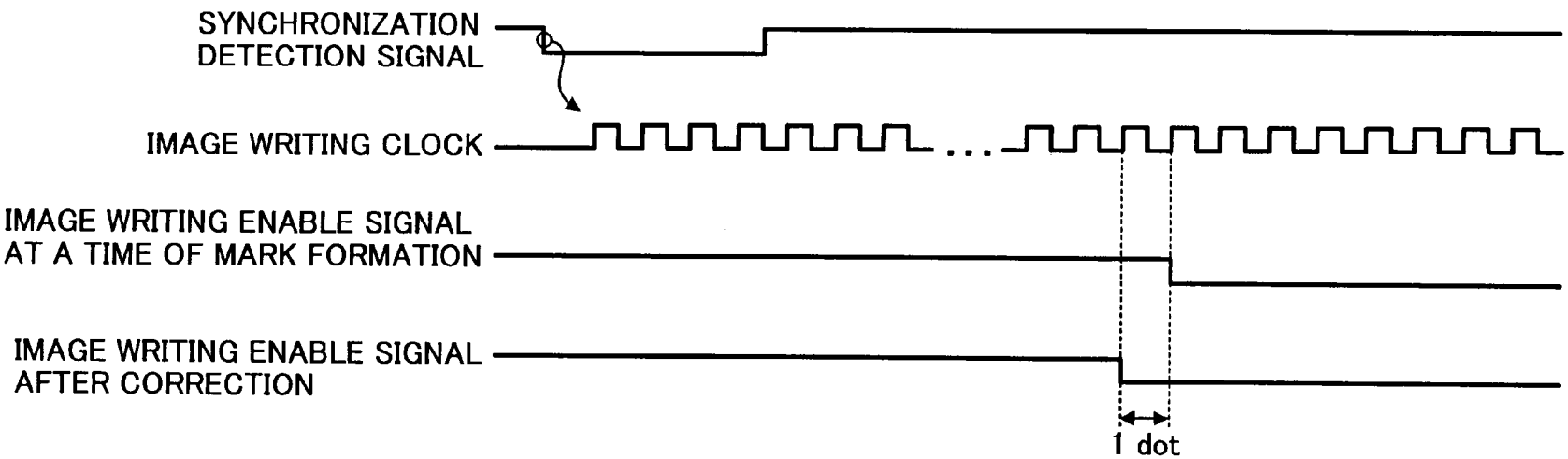
FIG. 4 illustrates the generation of a synchronization detection signal giving a time for correcting a write start time in a main scanning direction, a clock, an image write enable signal giving a time for forming marks, and a corrected image write enable signal in the first preferred embodiment.

Referring now to FIG. 4, a sequence of a synchronous detection signal for correcting a write start time in a main scanning direction, an image write clock, an image write enable signal for forming marks, and a corrected image write enable signal each generated in the first preferred embodiment will be described. It is premised in this preferred embodiment that correctable resolution is one dot, for example.

In each scanning line, an image write clock can be generated in substantially the same phase in response to a dropping edge of the synchronous detection signal. In addition to writing an image in synchronism with the clock signal, the image write enable signal is also generated in synchronism with the clock signal. For example, if a write start position is to be put forward by one dot in accordance with the above-mentioned mark detection and calculation, the write enable signal is preferably activated earlier by a time corresponding to one clock as illustrated in FIG. 4. Further, if it is detected as a result of the mark detection and calculation that a magnification is deviated from that of a reference color in the main scanning direction, the magnification can be changed using a device such as a clock generator employing a PLL (phase locked loop) capable of changing a frequency by a fine step.

The above-mentioned correction operation is executed, for example, at the same time when a power supply is turned ON and immediately initialized. The above mentioned correction operation can be automatically executed, when the temperature of a prescribed section such as a section of an exposure 11 is monitored and exceeds a prescribed level. The above mentioned correction operation can also be automatically executed immediately when a prescribed number of sheets has been printed. The above-mentioned correction operation can also be executed by an instruction of a user through a printer driver or an operational panel.

Figure 5:
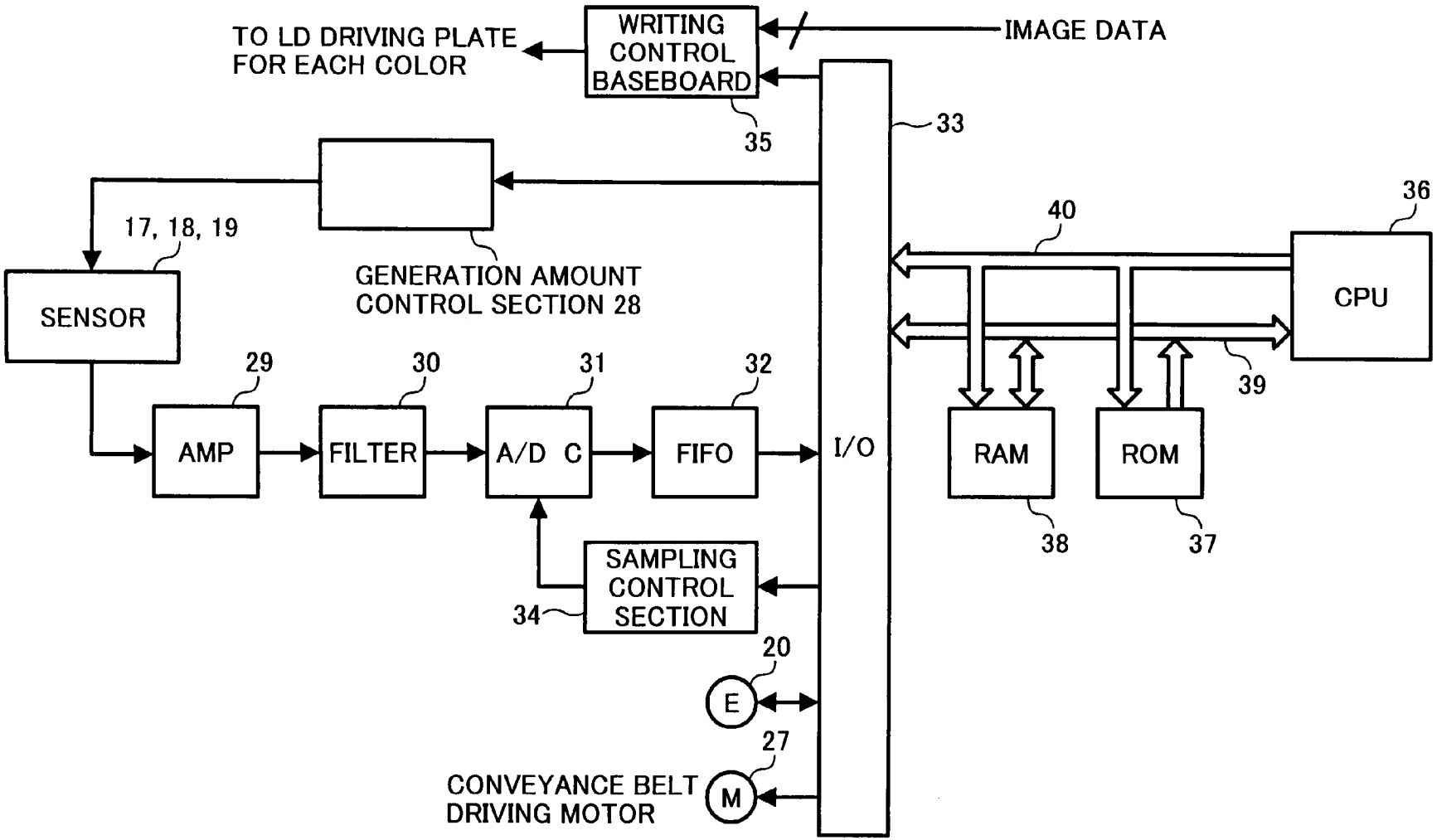
FIG. 5 illustrates the configuration of a section performing driving control in the first preferred embodiment.

An exemplary driving control section of the image forming apparatus of the first preferred embodiment is now described with reference to FIG. 5. As shown, the image forming apparatus includes the plurality of sensors 17, 18, and 19, the rotary encoder 20, the conveyance belt driving motor 27, a light intensity control section 28, an amplifier (AMP) 29, a filter 30, an A/D converter 31, an FIFO memory 32, an I/O port 33, a sampling control section 34, a write control section 34, a CPU 36, a ROM 37, a RAM 38, a data bus 39, and an address bus 40.

The plurality of sensors 17, 18, and 19 each include a light generation element and a photo-acceptance unit (each not shown) controlled by the light intensity control section 28. An output side of the plurality of sensors 17, 18, and 19 is connected to an I/O port 33 via the AMP 29, the filter 30, the A/D converter 31, and the FIFO memory 32.

A detection signal obtained from each of the plurality of sensors 17, 18, and 19 is amplified by the AMP 29, and converted from analog data to digital data by the A/D converter 31 via the filter 30. Sampling of data is controlled by the sampling control section 34, and sampled data is stored in the FIFO memory 32. The sampling control section 34, the FIFO memory 32, and a write control substrate 35 are connected to the I/O port 33.

Further, the rotary encoder 20 is connected to the I/O port 33 while a light generation section arranged within the rotary encoder 20 is controlled. An output pulse of the rotary encoder 20 is input to the I/O port 33 and the conveyance belt driving motor 27 is connected to the I/O port 33, thus forming a feedback control loop.

The I/O port 33, the CPU 36, a ROM 37, and a RAM 38 are connected to each other via a data bus 39 and an address bus 40.

In the ROM 37, various programs such as a program capable of calculating various displacement amounts of toner images, a program performing the feedback control, etc., which can be read by the CPU 36 are stored.

The CPU 36 designates ROM and RAM addresses and various input/output instruments using the address bus 40.

The CPU 36 monitors a detection signal transmitted from each of the plurality of sensors 17, 18, or 19 at a prescribed time, and controls an intensity of a light generated by each of the light generation elements through the light intensity control section 28. The CPU 36 also controls an output level of a light acceptance signal output from the light acceptance element to be constant so that the sensors 17, 18, and 19 can steadily detect a toner image even if the light generation elements and the conveyance belt 5 deteriorate. Further, the CPU 36 executes a prescribed setting to the write control substrate 35 to change registrations in the main and sub scanning directions based upon a correction value obtained from a detection result of the toner marks and change an image write frequency based upon an error in magnification. The write control substrate 35 includes a device such as a clock generator employing a VCO (voltage controlled oscillator) capable of extraordinarily finely setting an output frequency for each of the respective colors including a reference color. An output therefrom is used as an image write clock.

Further, the CPU 36 controls a stepping motor for skew adjustment use (not shown) arranged in the exposure 11 based upon a correction value obtained from the earlier mentioned detection result of the toner marks. Further, the CPU 36 counts a number pulses transmitted from the encoder, and obtains a current positional deviation in relation to a reference position. The CPU 36 then executes filter calculation for removing a prescribed deviation from the positional deviation, and applies proportional control calculation to the filter calculation result. The CPU 36 then outputs a control signal canceling the positional deviation to the conveyance driving motor 27, thereby stabilizing belt traveling.

Figure 6:
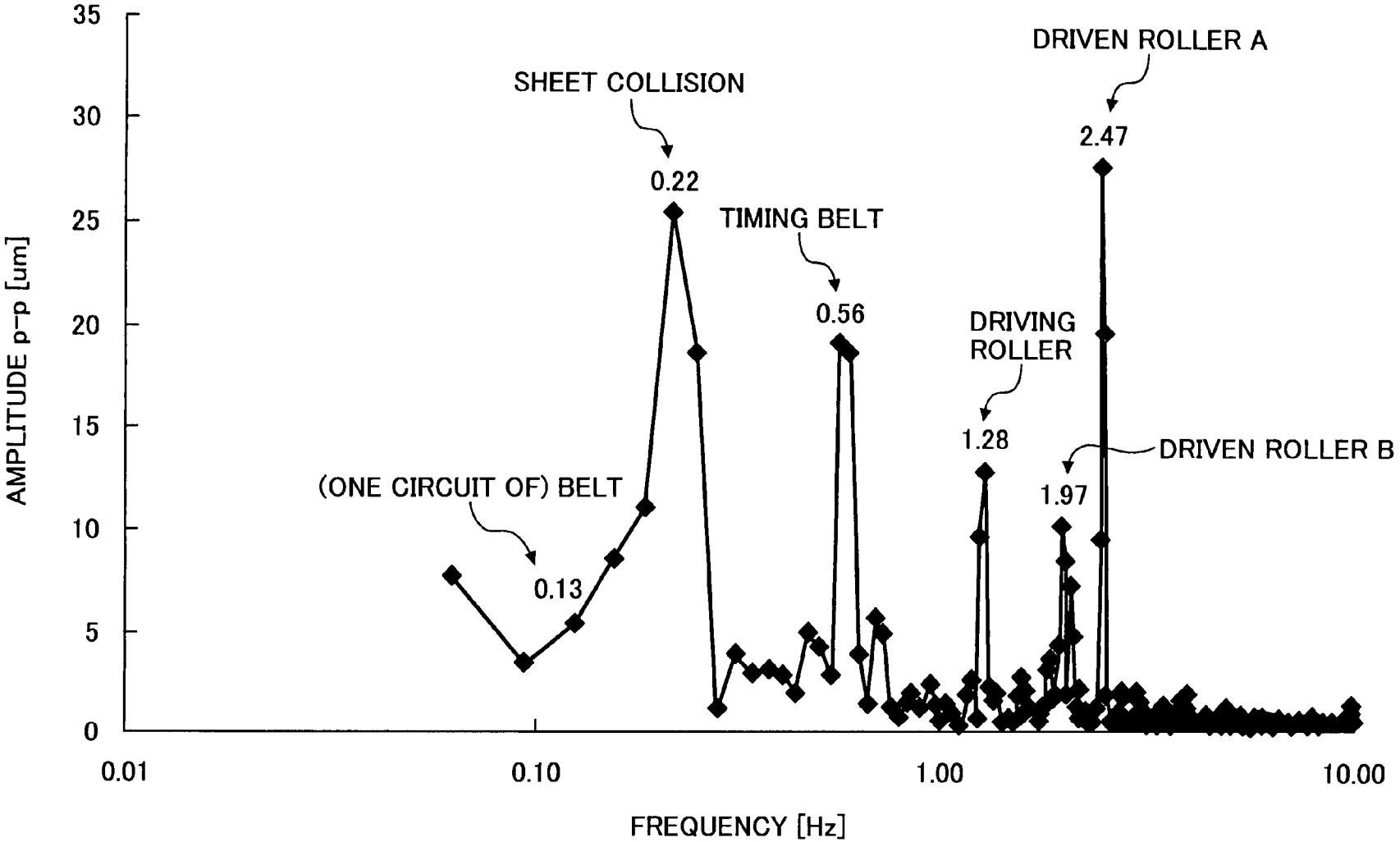
FIG. 6 illustrates the relationship between amplitude p-p of a displacement and a frequency detected by a rotary encoder when a driving source is decontrolled in accordance with the first preferred embodiment.

An exemplary relationship between a deviation occurrence frequency and its amplitude p-p detected by the rotary encoder 20 when the driving source is decontrolled is now described with reference to FIG. 6. As shown, various deviation occurrence frequencies of main spectrums are exemplified below. However, the respective frequencies vary based on design details of an image forming apparatus.

Specifically, a frequency of occurrence of deviation in a belt caused by unevenness of its own thickness may be 0.13 Hz. A frequency of collision shock caused when a transfer sheet collides may be 0.22 Hz. A frequency of deviation occurrence in a timing belt (not shown) that rotates a driving roller 7 with a driving motor may be 0.56 Hz. A frequency of deviation occurrence in a driving roller 7 caused by its own eccentricity may be 1.28 Hz. A frequency of deviation occurrence in a driven roller 8B caused by its own eccentricity may be 1.97 Hz. A frequency of deviation occurrence in the driven roller 8A caused by eccentric assembly of a rotary encoder 20 may be 2.47 Hz.

The above-mentioned various frequencies are stored in the ROM 37. Further, in the ROM 37, various causes of deviations at prescribed frequencies are stored and associated with the above-mentioned respective various frequencies.

Among the above-mentioned frequencies, 1.97 Hz and 2.47 Hz do not influence the traveling of the conveyance belt 5 at respective transfer stations. Also, if the conveyance belt driving motor 27 is controlled based upon such detection results (i.e., 1.97 Hz and 2.47 Hz), the belt traveling becomes unstable. Then, in the preferred embodiment, the below listed frequencies are filtered out as detection results (i.e., corresponding one or more deviations are removed) by a digital filtering process:

2.97 Hz of deviation in the driven roller 8B caused by its own center core eccentricity;

2.47 Hz of deviation in the driven roller 8A caused by center core eccentric assembly of the rotary encoder 20.

In this preferred embodiment, a conveyance belt driving motor 27 is a stepping motor. Accordingly, the CPU 36 controls the conveyance belt driving motor 27 by adjusting a driving pulse frequency to cancel traveling deviation detected on the conveyance belt 5.

Figure 7:
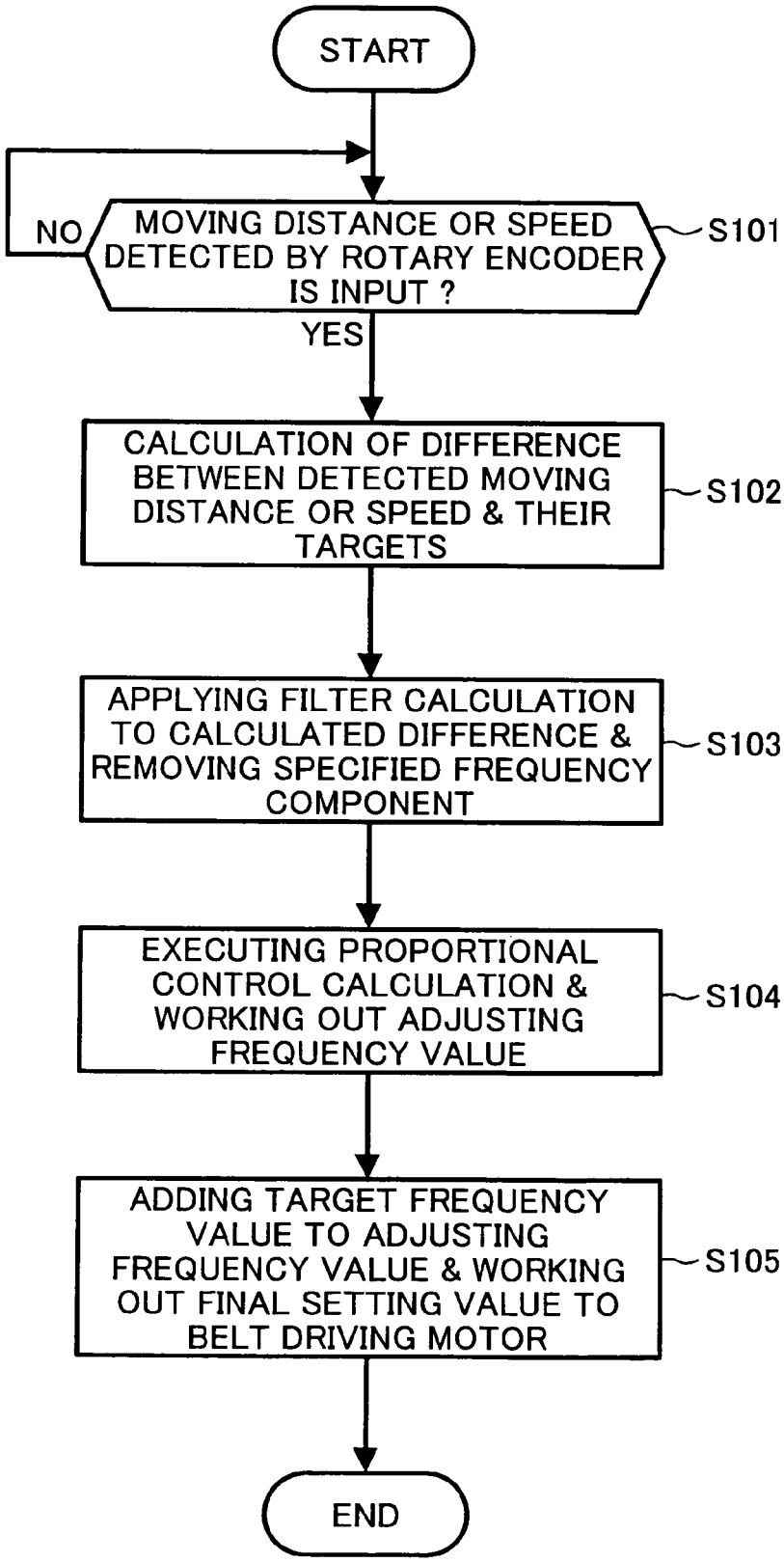
FIG. 7 is a flowchart illustrating a procedure of a calculation process performed by a CPU in the fist preferred embodiment.

A calculation process performed by the CPU 36 to control the conveyance belt driving motor 27 will now be described with reference to FIG. 7.

Initially, the CPU 36 determines if a moving length or speed information of the driven roller 8A is detected and input by the rotary encoder 20 (in step S101). If the moving length or speed information has not yet been input, the process of step S101 is repeated (No, in step S101).

If either the moving distance or speed information is determined as being input (Yes, in step S101), the CPU 36 reads a reference value for the moving length or speed (i.e., a moving length or speed of a driven roller 8A in an ordinary condition). The CPU 36 then calculates a deviation (in step S102) by subtracting the detected moving length or speed from a reference value.

Subsequently, the CPU 36 applies a filtering calculation process and filters out one or more negligible frequencies (e.g. frequencies caused by the driven rollers 8A and 8B) of deviations not giving influence to traveling of the conveyance belt 5 at the transfer stations in view of the calculated deviation (in step S103).

Subsequently, the CPU 36 applies a predetermined proportional control calculation process to the deviation value remaining after removal of the deviation occurring at the frequencies, and calculates a frequency to adjust (in step S104).

Subsequently, the CPU 36 adds the frequency to the reference value, and obtains a control frequency of a driving control pulse input to the conveyance belt driving motor 27 (in step S105). The CPU 36 then outputs the driving control pulse and controls the conveyance belt driving motor 27 to drive the driving roller 7 in a prescribed rotational speed.

Since slippage between the conveyance belt 5 and driven roller 8A is suppressed, belt moving distance information can be equivalent to the rotational angular information of the driven roller 8A.

As exemplary parameters used in controlling the conveyance belt driving motor 27 to drive are exemplified as follows:

Control cycle: 2 (ms);

Process line speed: V (mm/s);

Diameter of a driven roller 8A: d (mm);

Encoder resolution: p (pulse per round).

Now, the above-mentioned three calculation processes performed by the CPU 36 are described more in detail.

Specifically, the calculation process is performed to determine the rotational angular deviation (in step S102). The second calculation process is a digital filter calculation process (in step S103). The third calculation process is a proportional control calculation process (in steps S104 and S105).

In the first process, the CPU 36 calculates the below described formula, wherein parameter e(n) (rad) represents a rotational angular deviation calculated by a sampling, parameter θ 0 (rad) represents a rotational angle (=2π*V*2*E−3/dπ(rad)) per a control cycle 2 (ms), parameter θ1 represents a rotational angle (=2π/d ((rad) per one pulse of the rotary encoder 20, parameter q represents a count number of a control cycle timer, and parameter ne represents a pulse count number of the rotary encoder 20:

$$e(n)=\theta 0*q-\theta 1*ne \quad (1)$$

As shown in formula (1), the CPU 36 calculates angular deviation e(n) by subtracting an angle detected by the rotary encoder 20 from a reference value indicating normal rotation of the driven roller 8A.

In the second process, the CPU 36 applies the below specified filtering calculation to the above-described deviation e(n) and obtains e'(n) as a result. In the preferred embodiment filtering is achieved by the calculation of the CPU 36 includes the below described specifications stored in the ROM 37 as setting values to be read and used in the filtering process:

Type: Chebychev performance Low band pass IIR (infinite impulse response);

Ripple rate: 0.4 (dB);

Filtering order: Fourth;

Sampling frequency: 500 (Hz) (=control cycle);

Cutoff frequency: 1.4 (Hz).

In this preferred embodiment, the CPU 36 executes a filtering process to remove deviation caused by eccentricity of the driven rollers 8A and 8B at frequencies of 1.97 Hz and 2.47 Hz, because those frequencies do not influence the traveling of the conveyance belt 5 in the transfer steps. Thus, 1.4 Hz is set as a cutoff frequency, so that the CPU 36 filters out one or more frequencies such as 1.97 Hz, 2.47 Hz, etc., higher than 1.4 Hz.

Figure 8:
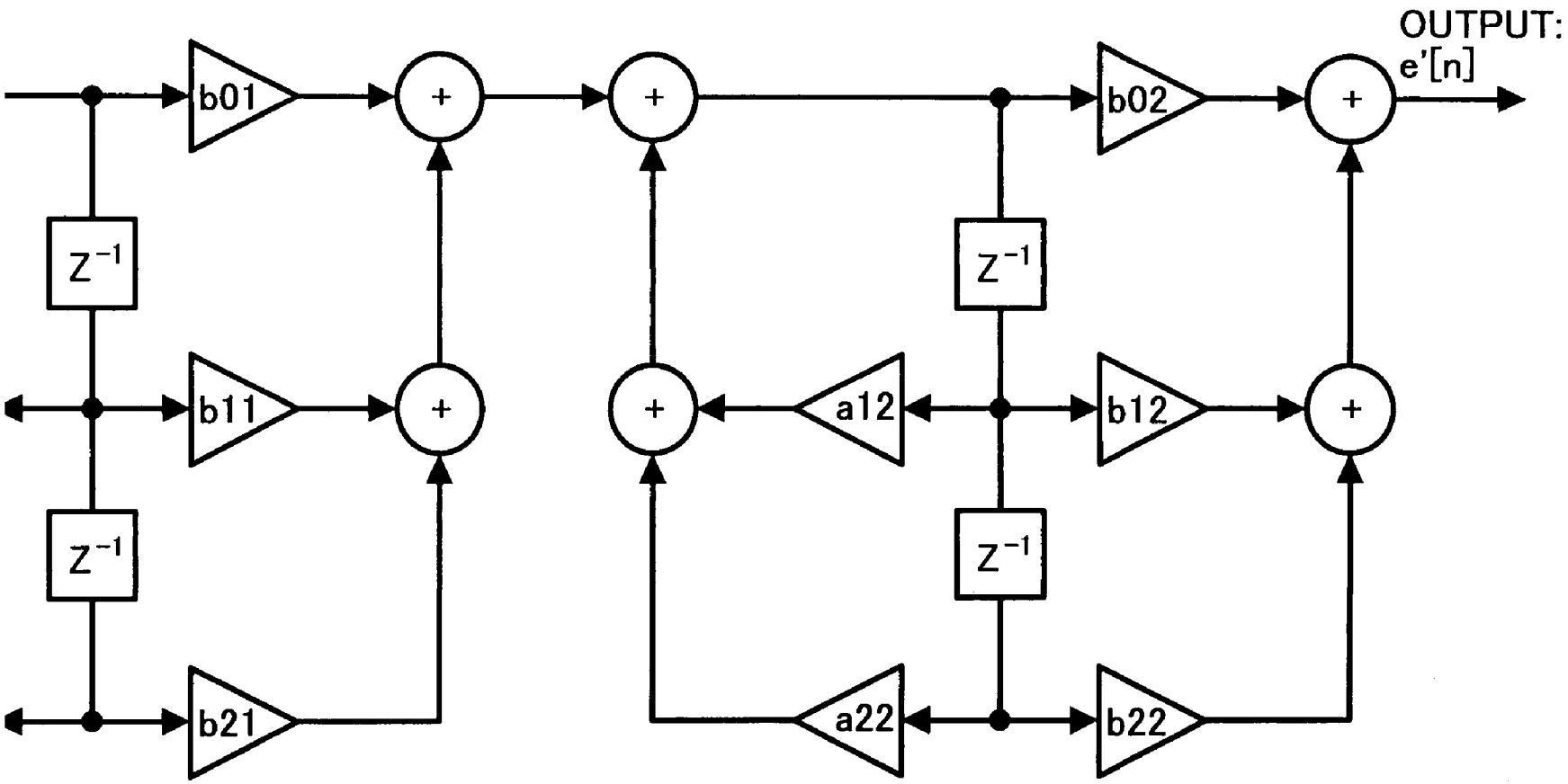
FIG. 8 illustrates a filter calculation process corresponding to a Chebychev character low band pass type IIR Low pass filter executed by the CPU of the first preferred embodiment.

Chebychev performance/low band pass/IIR low pass filtering executed by the CPU 36 of the first preferred embodiment as a filtering calculation process is now described in reference to FIG. 8. Since the method is known in the art, a description of the Chebychev performance low band pass/IIR/low pass filter is omitted.

When calculating based upon the above mentioned filtering calculation specifications, respective coefficients shown in FIG. 8 are obtained as follows:

a11=1.98410860;

a21=−0.98422702;

b01=0.00002893;

b11=0.00005786;

b21=0.00002893;

a12=1.99309956;

a22=−0.99343665;

b02=0.00008236;

b12=0.00016471;

b22=0.00008236.

Figure 9:
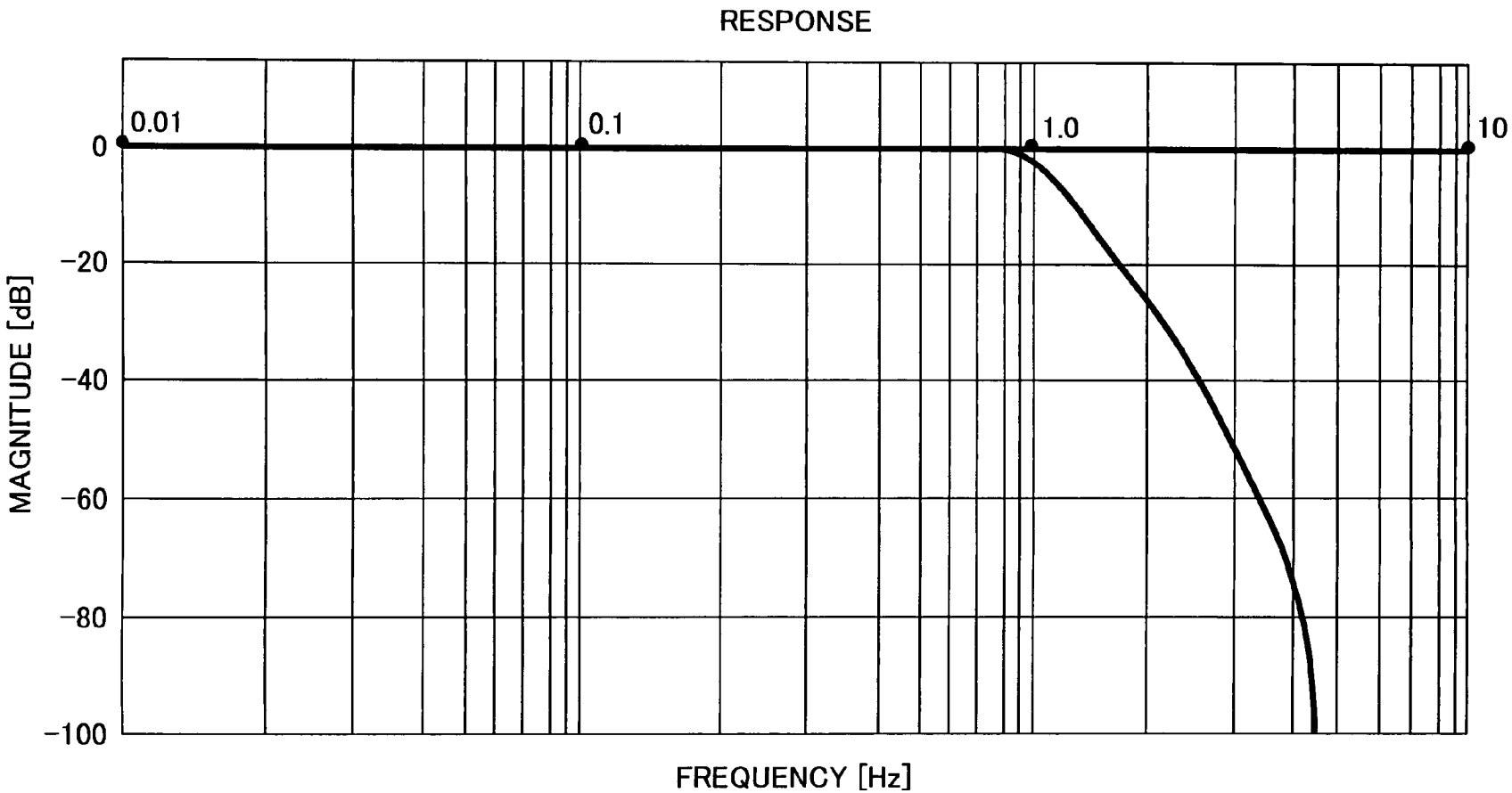
FIG. 9 illustrates a frequency-amplitude performance of a filter realized by calculation of the CPU of the first preferred embodiment, wherein a vertical axis represents an amplitude ratio (dB) and a horizontal axis, a frequency (Hz), respectively.
Figure 10:
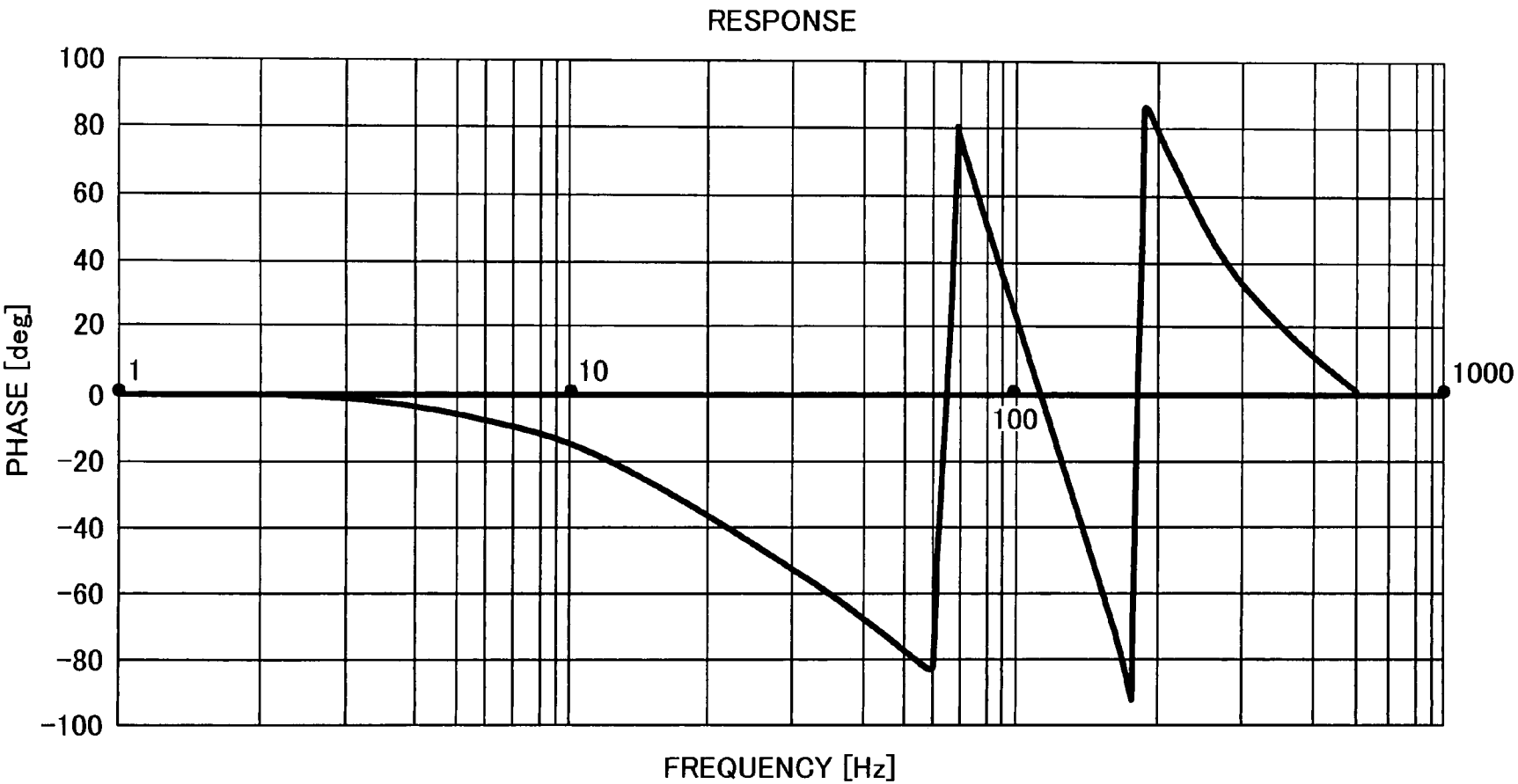
FIG. 10 illustrates a frequency-phase performance of a filter realized by calculation of the CPU of the first preferred embodiment, wherein a vertical axis represents a difference in phase (deg) and a horizontal axis, a frequency (Hz), respectively.

FIGS. 9 and 10 illustrate frequency-amplitude and frequency-phase performances of a filter, respectively, given by calculation of the CPU 36.

Figure 11:
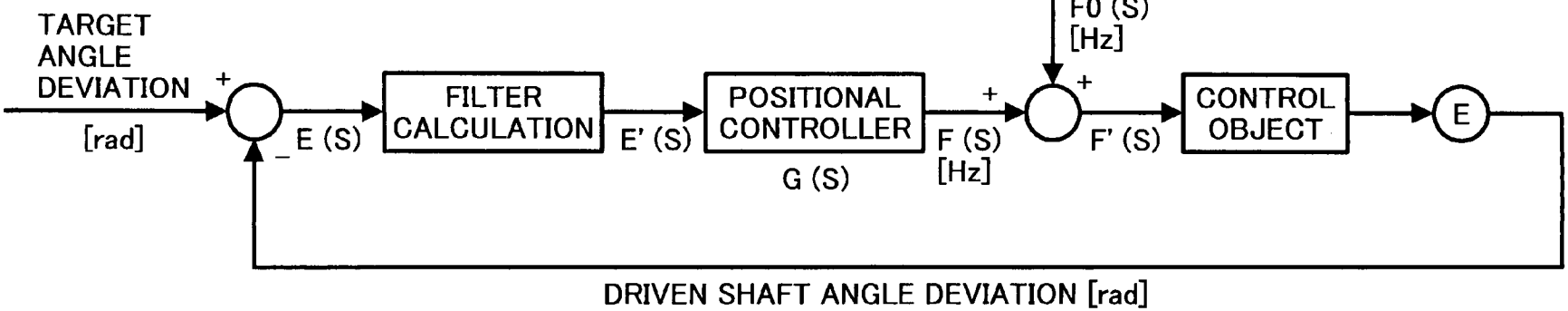
FIG. 11 illustrates an exemplary proportional control calculation process performed by the CPU of the first preferred embodiment.

In the third process, proportional control calculation is executed by the CPU 36 of the first preferred embodiment as shown in FIG. 11. Specifically, the following formulas are satisfied, wherein F(S) represents an adjustment value of a frequency of a driving control pulse to be input and control a conveyance belt driving motor 27 to drive, G(S) represents gain, E'(S) represents a rotational angular deviation obtained by subtracting a detected value from a reference value, S represents a frequency region, Kp represents proportional gain, Ki represents integration gain, and Kd represents differential gain.

$$F(S)=G(S)*E'(S)=Kp*E'(S)+Ki*E'(S)/S+Kd*S*E'(S)G(S)=F(S)/E'(S)=Kp+Ki/S+Kd*S \quad (i)$$

If applying bilinear conversion (i.e., $S=(2/T)*(1-Z^{-1}/(1+Z^{-1}))$ to formula (i), the following formula (ii) is obtained, wherein a1 is zero, a2 is one, b0 is represented by Kp+T*ki/2+2*Kd/T, b1 is represented by T*ki−4*Kd/T, and b2 is represented by −Kp+T*ki/2+2*Kd/t:

$$G(Z)=(b0+b1*Z^{-1}+b2*Z^{-2})/(1-a1*Z^{-1}-a2*Z^{-2}) \quad (ii)$$

Figure 12:
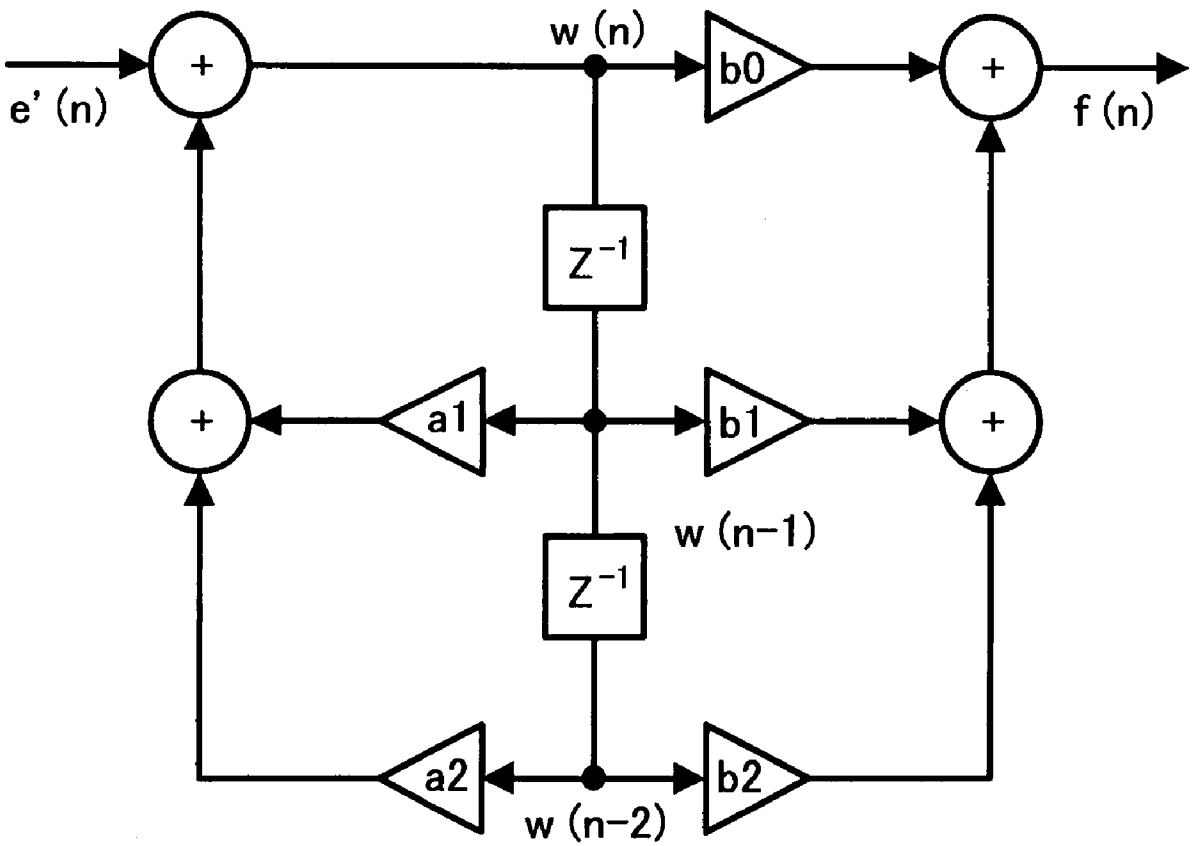
FIG. 12 illustrates an exemplary configuration of a calculation section calculating formula (ii) (i.e., G(Z)) in the first preferred embodiment.

Referring now to FIG. 12, a configuration of the calculation section calculating G(Z) is described, wherein e'(n) and f(n) represent parameters when E' (S) and F (S) are break-up data.

As shown, if intermediate nodes are defined as w (n), w (n−1), and w (n−2), the following differential equations are obtained (as a general formula of PID control), wherein index (n) represents a current sampling, (n−1) represents the last sampling, and (n−2) represent twice precedent sampling:

$$w(n)=a1*w(n-1)+a2*w(n-2)+e'(n) \quad (iii)$$

$$f(n)=b0*w(n)+b1*w(n-1)+b2*w(n-2) \quad (iv)$$

Now, if the CPU 36 executes the proportional control, the integration and differential gains become zero. Accordingly, respective coefficients of FIG. 12 become the following values, and the above listed formulas (iii) and (iv) are simplified into formulas (v):

$$w(n)=w(n-2)+e'(n)$$

$$f(n)=Kp*w(n)-Kp*w(n-2)=Kp*e'(n) \quad (v)$$

Further, when breakup data is f0 (n) Hz corresponding to F0 (S), a pulse frequency f'(n) to be set to the belt conveyance motor 27 is finally calculated by the following formula:

$$f'(n)=f(n)+f0(0)=Kp*e'(n)+f0(n)\ (\mathrm{Hz}) \quad (vi)$$

The CPU 36 controls the conveyance belt driving motor 27 based upon the driving control pulse calculated as above. Even though the CPU 36 of the preferred embodiment performs the filter calculation process later in the deviation calculation of the moving distance or speed (step S102), a deviation occurrence frequency not giving influence to traveling of the conveyance belt 5, at least in the transfer sections, can be removed from the moving distance or speed immediately after being detected by the rotary encoder 20 (in step S101). Otherwise, the above-mentioned needless frequency can be filtered in accordance with either f(n), calculated after the proportional control calculation (in step S104), or f'(n) finally calculated (in a latter step of step S104).

Further, the preferred embodiment employs the laser light as the exposure light source, but is not limited thereto. As one possible alternative, an LED array may also be employed.

Even if the filter realized by calculation of the CPU is the IIR filter type in the preferred embodiment, an FIR (finite impulse response) filter and a moving amount averaging manner or the like can be employed. Even if the preferred embodiment employs the low pass filter, a band pass filter can be used and the same result can be obtained.

Further, the preferred embodiment applies the filtering calculation to a calculated deviation. However, the filtering process can be applied either to the detected deviation or the frequency information related to the driving pulse driving the driving roller 7.

Further, the preferred embodiment executes the proportional control (i.e., P control). However, the present invention is not limited thereto, and PI, PID, H∞, and PLL (PhaseLockedLoop) controls can also be used.

Further, the present embodiment executes positional control based upon belt moving distance information, but the present invention is not limited thereto, and is able to execute speed control based upon belt moving speed information.

Further, the preferred embodiment is described as the color image forming apparatus, but may also be implemented in a mono-color image forming apparatus.

Further, the preferred embodiment detects the belt speed and position with the rotary encoder attached to the driven roller shaft. However, the present invention is not limited to this detection method and may detect a scale or a toner mark formed on either a front side or a rear side of the belt, for example.

Further, the preferred embodiment employs the stepping motor as a driving motor, but is not limited thereto. A DC motor or an AC motor and the like may also be used.

As described heretofore, according to the preferred embodiment, the image forming apparatus controls a moving speed of the conveyance belt 5 by executing a calculation process with the CPU 36 and determining a frequency of the driving control pulse input to the conveyance belt driving motor 27. To achieve such a goal, a frequency of occurrence of deviation caused by eccentricity of the driven rollers 8A and 8B, which does not give influence to traveling of the conveyance belt 5 in the transfer steps, is filtered out. As a result, the image forming apparatus cancels only a deviation of the moving distance or speed occurring at a prescribed frequency, giving influence to the traveling of the conveyance belt 5, thereby realizing a stable traveling thereof. Accordingly, even when a color image is formed by superposing a plurality of component color toners, displacement among image formation positions for component colors can be suppressed.

Further, according to the preferred embodiment, the above-mentioned calculation process can be achieved by software. In comparison with a hardware filter, with software a filtering performance deteriorates less as time elapses can be stable without varying, and cost can be reduced.

Further, according to the preferred embodiment, a driving speed of the conveyance belt driving motor 27 is controlled to cancel the deviation by removing a frequency of occurrence of rotational deviation in the driven roller 8A attached to the rotary shaft of the rotary encoder 20. Accordingly, a frequency not giving influence to traveling of the conveyance belt 5 through the transfer stations is filtered out, and thereby stable traveling can be achieved at least in the transfer stations.

Further, according to the preferred embodiment, since a driving speed of the conveyance belt driving motor 27 is controlled while removing a frequency of rotational deviation occurring in the driven roller 8B to cancel deviation, a frequency of the deviation not giving influence to traveling of the conveyance belt 5 in the transfer stations is filtered out, and stable traveling of the conveyance belt 5 can be achieved.

A configuration and operation of a second preferred embodiment of an image forming apparatus is now described with reference to FIG. 13. Various devices having the same reference numerals to those of the first preferred embodiment include and execute the same configuration and operation thereto.

Figure 13:
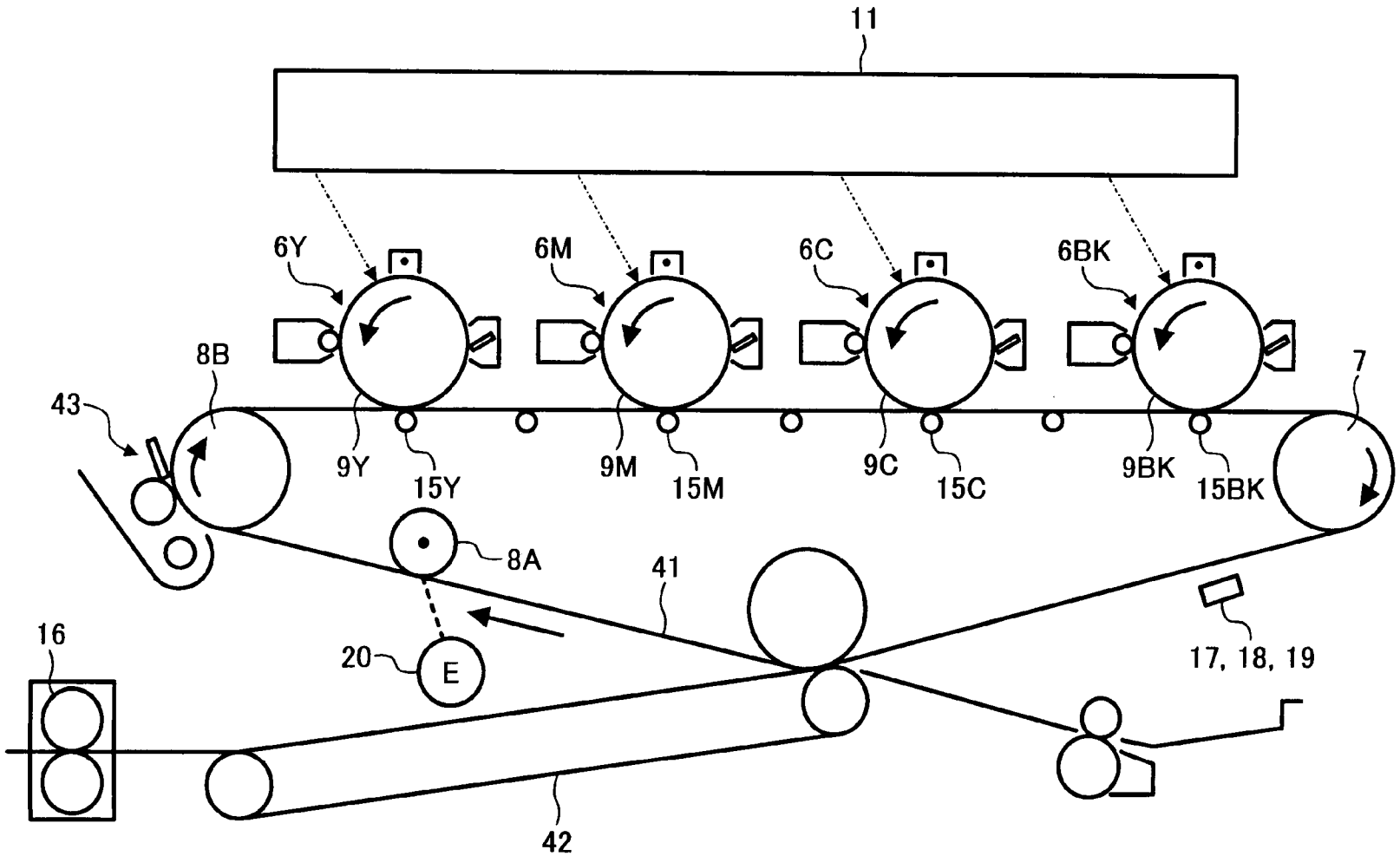
FIG. 13 illustrates an exemplary image forming apparatus of a second preferred embodiment.
Figure 14:
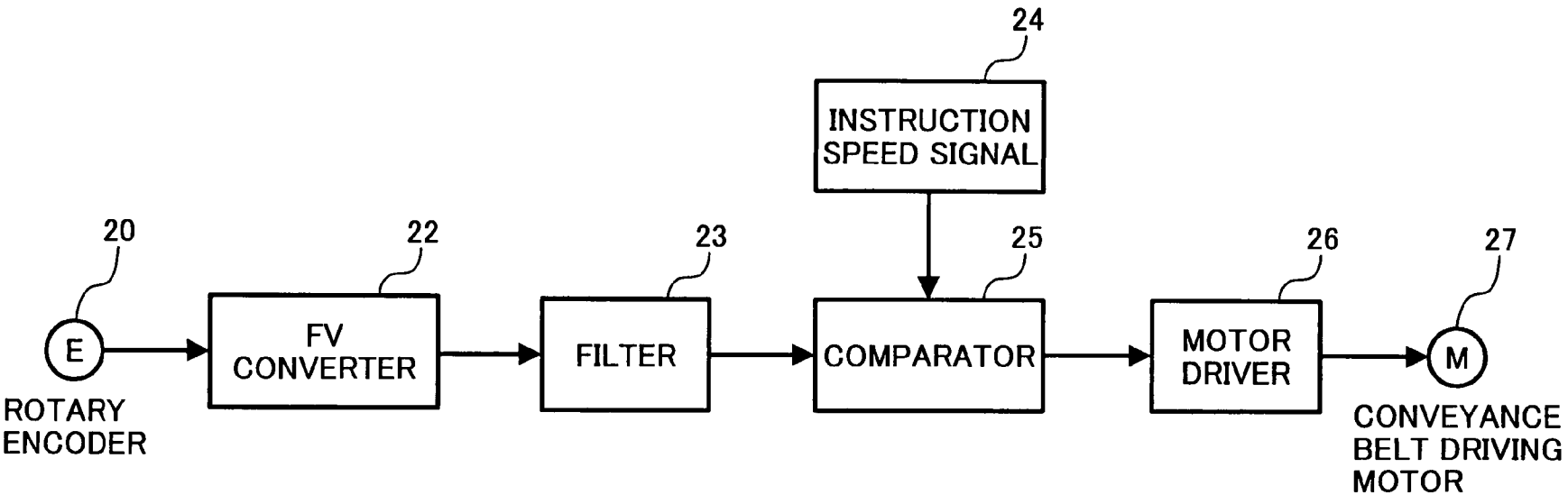
FIG. 14 illustrates a configuration of a background image forming apparatus capable of detecting and correcting a dynamic displacement (AC component) to stabilize a traveling performance of a conveyance belt.

Specifically, as shown in FIG. 13, the image forming apparatus includes a plurality of image forming sections 6Y, 6M, 6C, and 6BK, a driving roller 7, a pair of driven rollers 8A and 8B, a plurality of PC drums 9Y, 9M, 9C, and 9BK, an exposure device 11, a plurality of transfer devices 15Y, 15M, 15C, and 15BK, a fixing device 16, a plurality of sensors 17, 18, and 19, a rotary encoder 20, an intermediate transfer belt 41, a transfer belt 42, and a cleaning device 43.

As shown, instead of the conveyance belt 5 of FIG. 1, the intermediated transfer belt 41 is provided as an intermediate transfer member to temporary receive transfer of an image formed by the plurality of image forming sections 6Y, 6M, 6C, and 6BK, and then transfer the image on the intermediated transfer belt 41 to a sheet in cooperation with a transfer belt 42 as a transfer device. The transfer belt 42 conveys the sheet to the fixing device 16. Further, the cleaning device 43 cleans the intermediate transfer belt 41.

In the preferred embodiment, an objective for a toner mark forming device to form toner marks for positional detection use for respective component colors is the intermediated transfer belt 41. Thus, similar to the first preferred embodiment, the plurality of sensors 17, 18, and 19 are arranged in a main scanning direction perpendicular to the rotational direction of the intermediated transfer belt 41. Thus, a direction of an arrow in FIG. 13 corresponds to the rotational direction of the intermediated transfer belt 41, and a direction perpendicular to the arrow corresponds to the main scanning direction as an arrangement direction of the plurality of sensors 17, 18, and 19.

A plurality of toner patches for positional detection use are formed at a prescribed positions allowing these sensors 17, 18, and 19 to detect the toner patches. Thus, image formation positions on the PC drums 9Y, 9M, 9C, and 9BK can be corrected by detecting the positional detection use toner mark formed on the intermediated transfer belt 41.

Further, similar to the first embodiment, a driving roller 7, and a pair of driven rollers 8A and 8B are provided. A rotary encoder 20 is attached to a shaft of the driven roller 8A. By controlling a driving motor (not shown) in accordance with a detection result and forming a feedback loop, traveling of the intermediate transfer belt 41 can be stable.

Also, in this preferred embodiment, the CPU 36 cancels only deviation of the moving distance or speed of the intermediate transfer belt 41 having a prescribed frequency giving an influence to the traveling while removing the other frequency of deviation caused by the driven rollers 8A and 8B and executing a similar calculation process to that of the first embodiment. Thus, stable traveling of the intermediate transfer belt 41 is enabled. Accordingly, when a color image is formed by superposing a plurality of component colors, displacement in image formation positions for respective component colors can be suppressed.

Processing in each of the first and second preferred embodiments is executed by a computer program included in the image forming apparatus. Such a program is stored in a recording medium, such as an optical recording medium, a magnetic recording medium, an optical magnetic recording medium, or a semiconductor, etc., and can be loaded from either one of the recording medium or a prescribed external instrument connected via a network.

Numerous additional modifications and variations of the present invention are possible in light of the above teachings. It is therefore to be understood that within the scope of the appended claims, the present invention may be practiced otherwise that as specifically described herein.

What is claimed is:

1. An image forming apparatus, comprising:

a driving device configured to rotate and transport a moving member;

a moving value detecting device configured to detect one of a moving length and a moving speed of the moving member;

a deviation calculating device configured to calculate a deviation value of one of the moving length and the moving speed by subtracting the detected one of the moving length and the moving speed from a reference value;

an adjustment value calculating device configured to calculate an adjustment value in accordance with the calculated deviation value;

a driving speed control device configured to control a driving speed of the driving device in accordance with the calculated adjustment value; and a deviation removing device configured to remove prescribed deviation in one of the moving length and the moving speed detected by the moving value detecting device based on the calculated deviation value, and the calculated adjustment value;

wherein said deviation removing device removes deviation considering a prescribed section not affecting movement of the moving member at a transfer station.

2. The image forming apparatus of claim 1, further comprising: a driven roller contact-driven by the moving member, wherein said moving value detecting device is connected to a rotary shaft of said driven roller and said deviation removing device removes rotational deviation occurring in the driven roller.

3. The image forming apparatus of claim 1, further comprising:

a driven roller contact-driven by the moving member, wherein the deviation removing device removes rotational deviation occurring in the driven roller.

4. The image forming apparatus of claim 3, wherein said moving member includes one of a recording medium configured to receive the component color toner image and a conveyance belt configured to convey the recording medium.

5. The image forming apparatus of claim 3, wherein said moving member includes an intermediate transfer belt onto which the component color toner images are transferred.

6. An image forming method comprising:

rotating and transporting a moving member; detecting one of a moving length and a moving speed of the moving member;

calculating a deviation value of one of the moving length and the moving speed by subtracting the detected one of the moving length and the moving speed from a reference value;

calculating an adjustment value in accordance with the calculated deviation value;

controlling a driving speed of the driving device in accordance with the calculated adjustment value; and removing prescribed deviation in one of the moving length and the moving speed detected by the moving value detecting device based on the calculated deviation value and the calculated adjustment value;

wherein said removing prescribed deviation includes removing deviation considering a prescribed section not affecting movement of the moving member at a transfer station.

7. The image forming method of claim 6, wherein said detecting one of a moving length and a moving speed includes detecting data from a rotary shaft of a driven roller, and said removing prescribed deviation includes removing rotational deviation occurring in the driven roller.

8. The image forming apparatus of claim 6, wherein the removing prescribed deviation includes removing rotational deviation occurring in the driven roller.

9. The image forming apparatus according to claim 8, wherein said moving member includes one of a recording medium configured to receive the component color toner image and a conveyance belt configured to convey the recording medium.

10. The image forming apparatus according to claim 8, wherein said moving member includes an intermediate transfer belt onto which the component color toner images are transferred.

11. An image forming apparatus comprising:

means for rotating and transporting a moving member;

means for detecting one of a moving length and a moving speed of the moving member;

means for calculating a deviation value of one of the moving length and the moving speed by subtracting the detected one of the moving length and the moving speed from a reference value;

means for calculating an adjustment value in accordance with the calculated deviation value;

means for controlling a driving speed of the driving device in accordance with the calculated adjustment value; and means for removing prescribed deviation in one of the moving length and the moving speed detected by the means for detecting based on the calculated deviation value calculated and the calculated adjustment value;

wherein said means for removing removes the prescribed deviation considering a prescribed section not affecting movement of the moving member at a transfer station.

12. The image forming apparatus of claim 11, further comprising:

a driven roller contact-driven by the moving member, wherein said means for detecting is connected to a rotary shaft of said driven roller, and said means for removing removes rotational deviation occurring in the driven roller.

13. The image forming apparatus of claim 11, further comprising:

a driven roller contact-driven by the moving member, wherein the means for removing removes rotational deviation occurring in the driven roller.

14. The image forming apparatus of claim 13, wherein said moving member includes one of a recording medium configured to receive the component color toner image and a conveyance belt configured to convey the recording medium.

15. The image forming apparatus of claim 13, wherein said moving member includes an intermediate transfer belt onto which the component color toner images are transferred.

* * * * *